US012624412B2

(12) United States Patent
Yasutomi et al.

(10) Patent No.: US 12,624,412 B2
(45) Date of Patent: May 12, 2026

(54) STEEL SHEET AND MANUFACTURING METHOD THEREOF

(71) Applicant: NIPPON STEEL CORPORATION, Tokyo (JP)

(72) Inventors: Takashi Yasutomi, Tokyo (JP); Eisaku Sakurada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 325 days.

(21) Appl. No.: 18/036,996

(22) PCT Filed: Nov. 19, 2021

(86) PCT No.: PCT/JP2021/042627

§ 371 (c)(1),
(2) Date: May 15, 2023

(87) PCT Pub. No.: WO2022/180956

PCT Pub. Date: Sep. 1, 2022

(65) Prior Publication Data

US 2023/0407430 A1 Dec. 21, 2023

(30) Foreign Application Priority Data

Feb. 26, 2021 (JP) ..... 2021-030349

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 6/002* (2013.01); *C21D 6/005* (2013.01); *C21D 6/008* (2013.01); *C21D 8/0205* (2013.01); *C21D 8/021* (2013.01); *C21D 8/0226* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01);
(Continued)

(58) Field of Classification Search
None
See application file for complete search history.

(56) References Cited

U.S. PATENT DOCUMENTS

2014/0030546 A1* 1/2014 Suwa ..... C21D 8/02 148/333

FOREIGN PATENT DOCUMENTS

JP 3858146 B2 12/2006
JP 5068688 B2 11/2012

* cited by examiner

*Primary Examiner* — Anthony M Liang
(74) *Attorney, Agent, or Firm* — Birch, Stewart, Kolasch & Birch, LLP

(57) ABSTRACT

This steel sheet has predetermined chemical composition and microstructure, in a crystal orientation distribution function of a texture at a sheet thickness ¼ position, when A/B that is a ratio of a maximum value A of pole densities at $\Phi=20°$ to $60°$ and $\varphi_1=30°$ to $90°$ in a cross section of $\varphi_2=45°$ to a maximum value B of pole densities at $\Phi=120°$ to $60°$ and $\varphi_1=30°$ to $90°$ in the cross section of $\varphi_2=45°$ is 1.50 or less, a total of the maximum value A and the maximum value B is 6.00 or less, and a tensile strength is 1030 MPa or more.

6 Claims, 1 Drawing Sheet

(51) Int. Cl.

| | |
|---|---|
| ***C21D 6/00*** | (2006.01) |
| ***C21D 8/02*** | (2006.01) |
| ***C21D 8/021*** | (2026.01) |
| ***C21D 8/0221*** | (2026.01) |
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.

CPC ..... *C22C 38/26* (2013.01); *C22C 38/28* (2013.01); *C22C 38/32* (2013.01); *C22C 38/38* (2013.01); *C21D 2211/002* (2013.01); *C21D 2211/008* (2013.01)

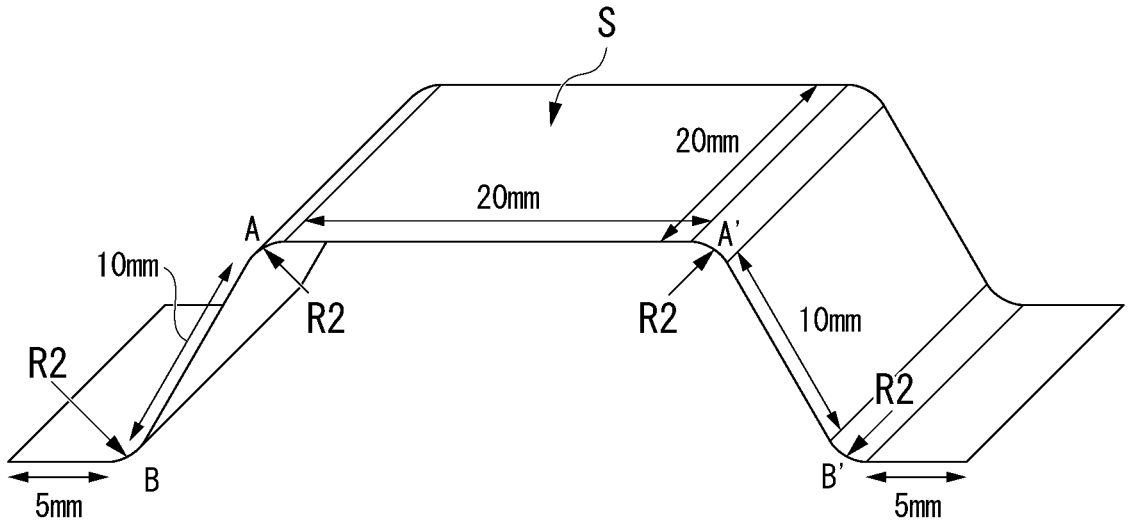
S
20mm
20mm
A
A'
10mm
R2
R2
10mm
R2
R2
B
B'
5mm
5mm

STEEL SHEET AND MANUFACTURING METHOD THEREOF

TECHNICAL FIELD OF THE INVENTION

The present invention relates to a steel sheet and a manufacturing method thereof.

Priority is claimed on Japanese Patent Application No. 2021-030349, filed Feb. 26, 2021, the content of which is incorporated herein by reference.

BACKGROUND ART

In recent years, weight reduction of automobiles and machine components has been underway. Designing an optimum shape as the component shape ensures stiffness and thereby makes it possible to reduce the weights of automobiles and machine components. Furthermore, in blank-formed components such as a press-formed component, the weights can be reduced by reducing the sheet thicknesses of component materials. However, in the case of attempting to ensure the strength properties of components such as static fracture strength and yield strength while reducing the sheet thicknesses, it becomes necessary to use high-strength materials. In particular, for automobile suspension components such as lower control arms, trailing arms, and knuckles, studies have begun about the application of higher than 780 MPa-grade steel sheets. These automobile suspension components are manufactured by performing burring, stretch flanging, bending forming, or the like on steel sheets. Therefore, steel sheets that are applied to these automobile suspension components are required to have excellent formability, particularly, excellent hole expansibility.

For example, Patent Document 1 discloses a hot-rolled steel sheet in which, in a hot rolling step, the finishing temperature and the rolling reduction are set within predetermined ranges, thereby controlling the grain sizes and aspect ratios of prior austenite and reducing anisotropy.

Patent Document 2 discloses a cold-rolled steel sheet in which, in a hot rolling step, the rolling reduction and the average strain rate are set within appropriate ranges in a predetermined finishing temperature range, thereby improving the toughness.

In order to further reduce the weights of automobiles, machine components, and the like, it is also expected to apply steel sheets having a sheet thickness premised on a cold-rolled steel sheet to automobile suspension components. The techniques described in Patent Document 1 and Patent Document 2 are effective in the manufacturing of automobile suspension components to which a high strength steel sheet is applied. In particular, these techniques are important findings for obtaining an effect relating to the formability and impact properties of suspension components of automobiles having a complicated shape.

However, automobile suspension components always receive cyclic loads attributed to weight-induced vibration, turning, obduction, and the like. Therefore, durability suitable for components is an important property. As described above, suspension components of automobiles are subjected to various formings. In a flat portion near the inside of an R portion that has been bent or bent and bent back, there are many places where the contact with a die is weak. Such a flat portion near the inside of the R portion has surface properties in which relatively sharp concaved parts are periodically formed due to the development of unevenness on the surface layer by forming and contact with a die at a weak load (hereinafter, a change in such surface properties will be referred to as forming damage). In a component including a portion damaged by forming (forming-damaged portion), stress and strain are likely to concentrate, and the component strength decreases. Therefore, for steel sheets that are formed and applied to automobile suspension components, it is required that the occurrence of forming damage can be suppressed.

PRIOR ART DOCUMENT

Patent Document

[Patent Document 1] Japanese Patent No. 5068688
[Patent Document 2] Japanese Patent No. 3858146

DISCLOSURE OF THE INVENTION

Problems to be Solved by the Invention

In view of the above-described circumstances, an object of the present invention is to provide a steel sheet having a high strength and excellent hole expansibility and being capable of suppressing the occurrence of forming damage and a manufacturing method thereof.

Means for Solving the Problem

As a result of original studies, the present inventors found that the occurrence of forming damage correlates with the texture of the surface layer of a steel sheet. The present inventors found that, in the texture of the surface layer of a steel sheet, in a case where the pole density is high and the symmetry is low, forming damage is likely to occur. Particularly, in a steel sheet having a tensile strength of 1030 MPa or more for which precipitation hardening has been used, since recrystallization is unlikely to occur during finish rolling, the pole density is high and the symmetry is low in the texture. The present inventors found that, in the texture of the surface layer of a steel sheet, the occurrence of forming damage can be suppressed by preferably controlling the ratio and total of pole densities in desired ranges.

In addition, the present inventors found that, in order to control the texture of the surface layer of a steel sheet preferably, it is effective to apply a desired strain to a slab before finish rolling in the width direction of the slab and to perform finish rolling under desired conditions.

The gist of the present invention made based on the above-described findings is as follows.

(1) A steel sheet according to one aspect of the present invention, containing, as a chemical composition, by mass %:

C: 0.030% to 0.180%,
Si: 0.030% to 1.400%,
Mn: 1.60% to 3.00%,
Al: 0.010% to 0.700%,
P: 0.0800% or less,
S: 0.0100% or less,
N: 0.0050% or less,
Ti: 0.020% to 0.180%,
Nb: 0.010% to 0.050%,
Mo: 0% to 0.600%,
V: 0% to 0.300%,
a total of Ti, Nb, Mo, and V: 0.100% to 1.130%,
B: 0% to 0.0030%,
Cr: 0% to 0.500%, and
a remainder of Fe and impurities,
in which a microstructure includes, in terms of area ratio, bainite: 80.0% or more, a total of fresh martensite and tempered martensite: 20.0% or less, and a total of pearlite, ferrite, and austenite: 20.0% or less, in a crystal orientation distribution function of a texture at a sheet thickness ¼ position, A/B that is a ratio of a maximum value A of pole densities at $\Phi=20°$ to 60° and $\varphi_1=30°$ to 90° in a cross section of $\varphi_2=45°$ to a maximum value B of pole densities at $\Phi=120°$ to 60° and $\varphi_1=30°$ to 90° in the cross section of $\varphi_2=45°$ is 1.50 or less, a total of the maximum value A and the maximum value B is 6.00 or less, and a tensile strength is 1030 MPa or more.

(2) In the steel sheet according to (1), a proportion of the area ratio of the tempered martensite in the total of the area ratios of the fresh martensite and the tempered martensite may be 80.0% or more.

(3) The steel sheet according to (1) or (2) may contain, as the chemical composition, by mass %, one or more selected from the group consisting of, as the chemical composition:

Mo: 0.001% to 0.600%,

V: 0.010% to 0.300%,

B: 0.0001% to 0.0030%, and

Cr: 0.001% to 0.500%.

(4) A manufacturing method of a steel sheet according to another aspect of the present invention is a manufacturing method of the steel sheet according to (1), including:

a step of holding a slab having the chemical composition according to (1) in a temperature range of 1200° C. or higher for 30 minutes or longer, a step of applying a strain of 3% to 15% in a width direction to the slab after the holding, a step of performing finish rolling on the slab to which the strain has been applied so that a final rolling reduction is 24% to 60% and a finishing temperature is in a temperature range of 960° C. to 1060° C., and a step of cooling the steel sheet after the finish rolling so that an average cooling rate in a temperature range of 900° C. to 650° C. becomes 30° C./second or faster and coiling the steel sheet in a temperature range of 400° C. to 580° C.

(5) The manufacturing method of a steel sheet according to (4) may further include a step of holding the steel sheet after the coiling in a temperature range of 600° C. to 750° C. for 60 to 3010 seconds.

Effects of the Invention

According to the above-described aspects of the present invention, it is possible to provide a steel sheet having a high strength and excellent hole expansibility and being capable of suppressing the occurrence of forming damage and a manufacturing method thereof. In addition, according to preferable aspects of the present invention, it is possible to provide a steel sheet having superior hole expansibility and a manufacturing method thereof.

BRIEF DESCRIPTION OF THE DRAWINGS

FIG. 1 is a view for describing a hat component made in an example.

EMBODIMENTS OF THE INVENTION

Hereinafter, a steel sheet according to the present embodiment will be described in detail. However, the present invention is not limited only to a configuration disclosed in the present embodiment and can be modified in a variety of manners within the scope of the gist of the present invention.

Numerical limiting ranges expressed below using "to" include the lower limit and the upper limit in the ranges. Numerical values expressed with "more than" and "less than" are not included in numerical ranges. "%" regarding chemical compositions all indicates "mass %".

The steel sheet according to the present embodiment contains, by mass %, C: 0.030% to 0.180%, Si: 0.030% to 1.400%, Mn: 1.60% to 3.00%, Al: 0.010% to 0.700%, P: 0.0800% or less, S: 0.0100% or less, N: 0.0050% or less, Ti: 0.020% to 0.180%, Nb: 0.010% to 0.050%, a total of Ti, Nb, Mo, and V: 0.100% to 1.130%, and a remainder: Fe and an impurity. Hereinafter, each element will be described in detail.

C: 0.030% to 0.180%

C is an element necessary to obtain a desired tensile strength of the steel sheet. When the C content is less than 0.030%, a desired tensile strength cannot be obtained. Therefore, the C content is set to 0.030% or more. The C content is preferably 0.060% or more, more preferably 0.080% or more, and still more preferably 0.085% or more, 0.090% or more, 0.095% or more, or 0.100% or more.

On the other hand, when the C content is more than 0.180%, the total of the area ratios of fresh martensite and tempered martensite becomes excessive, and the hole expansibility of the steel sheet deteriorates. Therefore, the C content is set to 0.180% or less. The C content is preferably 0.170% or less and more preferably 0.150% or less.

Si: 0.030% to 1.400%

Si is an element that improves the tensile strength of the steel sheet by solid solution strengthening. When the Si content is less than 0.030%, a desired tensile strength cannot be obtained. Therefore, the Si content is set to 0.030% or more. The Si content is preferably 0.040% or more and more preferably 0.050% or more.

On the other hand, when the Si content is more than 1.400%, the area ratio of residual austenite increases, and the hole expansibility of the steel sheet deteriorates. Therefore, the Si content is set to 1.400% or less. The Si content is preferably 1.100% or less and more preferably 1.000% or less.

Mn: 1.60% to 3.00%

Mn is an element necessary to improve the strength of the steel sheet. When the Mn content is less than 1.60%, the area ratio of ferrite becomes too high, and a desired tensile strength cannot be obtained. Therefore, the Mn content is set to 1.60% or more. The Mn content is preferably 1.80% or more and more preferably 2.00% or more.

On the other hand, when the Mn content is more than 3.00%, the toughness of a cast slab deteriorates, and hot rolling is not possible. Therefore, the Mn content is set to 3.00% or less. The Mn content is preferably 2.70% or less and more preferably 2.50% or less.

Al: 0.010% to 0.700%

Al is an element that acts as a deoxidizing agent and improves the cleanliness of steel. When the Al content is less than 0.010%, a sufficient deoxidation effect cannot be obtained, and a large amount of an inclusion (oxide) is formed in the steel sheet. Such an inclusion degrades the workability of the steel sheet. Therefore, the Al content is set to 0.010% or more. The Al content is preferably 0.020% or more and more preferably 0.030% or more.

On the other hand, when the Al content is more than 0.700%, casting becomes difficult. Therefore, the Al content is set to 0.700% or less. The Al content is preferably 0.600% or less and more preferably 0.100% or less.

P: 0.0800% or Less

P is an element that segregates in the sheet thickness center portion of the steel sheet. In addition, P is also an element that embrittles a welded part. When the P content is more than 0.0800%, the hole expansibility of the steel sheet deteriorates. Therefore, the P content is set to 0.0800% or less. The P content is preferably 0.0200% or less and more preferably 0.0100% or less.

The P content is preferably as low as possible and is preferably 0%; however, when the P content is excessively reduced, the dephosphorization cost significantly increases. Therefore, the P content may be set to 0.0005% or more.

S: 0.0100% or Less

S is an element that embrittles slabs by being present as a sulfide. In addition, S is also an element that degrades the workability of the steel sheet. When the S content is more than 0.0100%, the hole expansibility of the steel sheet deteriorates. Therefore, the S content is set to 0.0100% or less. The S content is preferably 0.0080% or less and more preferably 0.0050% or less.

The S content is preferably as low as possible and is preferably 0%; however, when the S content is excessively reduced, the desulfurization cost significantly increases. Therefore, the S content may be set to 0.0005% or more.

N: 0.0050% or Less

N is an element that forms a coarse nitride in steel and degrades the bending workability and elongation of the steel sheet. When the N content is more than 0.0050%, the hole expansibility of the steel sheet deteriorates. Therefore, the N content is set to 0.0050% or less. The N content is preferably 0.0040% or less and more preferably 0.0035% or less.

The N content is preferably as low as possible and is preferably 0%; however, when the N content is excessively reduced, the denitrogenation cost significantly increases. For this reason, the N content may be set to 0.0005% or more.

Ti: 0.020% to 0.180%

Ti is an element that increases the strength of the steel sheet by forming a fine nitride in steel. When the M content is less than 0.020%, a desired tensile strength cannot be obtained. Therefore, the Ti content is set to 0.020% or more. The Ti content is preferably 0.050% or more and more preferably 0.080% or more.

On the other hand, when the Ti content is more than 0.180%, the hole expansibility of the steel sheet deteriorates. Therefore, the TI content is set to 0.180% or less. The Ti content is preferably 0.160% or less and more preferably 0.150% or less.

Nb: 0.010% to 0.050%

Nb is an element that suppresses abnormal grain growth of austenite grains in hot rolling. In addition, Nb is also an element that increases the strength of the steel sheet by forming a fine carbide. When the Nb content is less than 0.010%, a desired tensile strength cannot be obtained. Therefore, the Nb content is set to 0.010% or more. The Nb content is preferably 0.013% or more and more preferably 0.015% or more.

On the other hand, when the Nb content is more than 0.050%, the toughness of the cast slab deteriorates, and hot rolling is not possible. Therefore, the Nb content is set to 0.050% or less. The Nb content is preferably 0.040% or less and more preferably 0.035% or less.

Total of Ti, Nb, Mo, and V: 0.100% to 1.130%

In the present embodiment, the total of the contents of Ti and Nb, which have been described above, and Mo and V, which will be described below, is controlled.

When the total of the contents of these elements is less than 0.100%, an effect of increasing the strength of the steel sheet by forming a fine carbide cannot be sufficiently obtained, and a desired tensile strength cannot be obtained. Therefore, the total of the contents of these elements is set to 0.100% or more. It is not necessary to contain all of Ti, Nb, Mo, and V, and the above-described effect can be obtained as long as the content of any one thereof is 0.100% or more. The total of the contents of these elements is preferably 0.150% or more, more preferably 0.200% or more, and still more preferably 0.230% or more.

On the other hand, when the total of the contents of these elements is more than 1.130%, the hole expansibility of the steel sheet deteriorates. Therefore, the total of the contents of these elements is set to 1.130% or less. The total of the contents of these elements is preferably 1.000% or less and more preferably 0.500% or less.

The remainder of the chemical composition of the steel sheet according to the present embodiment may be Fe and an impurity. In the present embodiment, the impurity means a substance that is incorporated from ore as a raw material, a scrap, a manufacturing environment, or the like or is allowed to an extent that the steel sheet according to the present embodiment is not adversely affected.

The steel sheet according to the present embodiment may contain the following arbitrary elements instead of some of Fe. In a case where the arbitrary element is not contained, the lower limit of the content is 0%. Hereinafter, each arbitrary element will be described.

Mo: 0.001% to 0.600%

Mo is an element that increases the strength of the steel sheet by forming a fine carbide in steel. In order to reliably obtain this effect, the Mo content is preferably set to 0.001% or more.

On the other hand, when the Mo content is more than 0.600%, the hole expansibility of the steel sheet deteriorates. Therefore, the Mo content is set to 0.600% or less.

V: 0.010% to 0.300%

V is an element that increases the strength of the steel sheet by forming a fine carbide in steel. In order to reliably obtain this effect, the V content is preferably set to 0.010% or more.

On the other hand, when the V content is more than 0.300%, the hole expansibility of the steel sheet deteriorates. Therefore, the V content is set to 0.300% or less.

B: 0.0001% to 0.0030%

B is an element that suppresses the formation of ferrite in a cooling step and increases the strength of the steel sheet. In order to reliably obtain this effect, the B content is preferably set to 0.0001% or more.

On the other hand, even when more than 0.0030% of B is contained, the above-described effect is saturated. Therefore, the B content is set to 0.0030% or less.

Cr: 0.001% to 0.500%

Cr is an element that develops an effect similar to that of Mn. In order to reliably obtain an effect of improving the strength of the steel sheet by containing Cr, the Cr content is preferably set to 0.001% or more.

On the other hand, even when more than 0.500% of Cr is contained, the above-described effect is saturated. Therefore, the Cr content is set to 0.500% or less.

The above-described chemical composition of the steel sheet may be analyzed using a spark discharge emission spectrophotometer or the like. For C and S, values identified by combusting the hot-rolled steel sheet in an oxygen stream using a gas component analyzer or the like and measuring C and S by an infrared absorption method are adopted. In addition, for N, a value identified by melting a test piece collected from the steel sheet in a helium stream and measuring N by a thermal conductivity method is adopted.

Next, the microstructure of the steel sheet according to the present embodiment will be described.

In the steel sheet according to the present embodiment, the microstructure includes, in terms of area ratio, bainite: 80.0% or more, a total of fresh martensite and tempered martensite: 20.0% or less, and a total of pearlite, ferrite, and austenite: 20.0% or less, and, in a crystal orientation distribution function of the texture at a sheet thickness ¼ position, A/B that is the ratio of a maximum value A of pole densities at $\Phi$=20° to 60° and $\varphi_1$=30° to 90° in a cross section of $\varphi_2$=450 to a maximum value B of pole densities at $\Phi$=1200 to 60° and $\varphi_1$=30° to 90° in the cross section $\varphi_2$=45° is 1.50 or less, and the total of the maximum value A and the maximum value B is 6.00 or less.

Hereinafter, each regulation will be described. Regarding the microstructure to be described below, "%" all indicates "area %".

Area Ratio of Bainite: 80.0% or More

Bainite is a structure having an excellent balance between ductility and hole expansibility while having a predetermined strength. When the area ratio of bainite is less than 80.0%, desired tensile strength and/or hole expansibility cannot be obtained. Therefore, the area ratio of bainite is set to 80.0% or more. The area ratio of bainite is preferably 81.0% or more, more preferably 82.0% or more, and still more preferably 83.0% or more.

The upper limit of the area ratio of bainite is not particularly limited, but may be 100.0% or less, 95.0% or less, or 90.0% or less.

Total of Area Ratios of Fresh Martensite and Tempered Martensite: 20.0% or Less

Fresh martensite and tempered martensite have an effect of increasing the strength of the steel sheet, but the local deformability is low, and an increase in the area ratio degrades the hole expansibility of the steel sheet. When the total of the area ratios of fresh martensite and tempered martensite exceeds 20.0%, the hole expansibility of the steel sheet deteriorates. Therefore, the total of the area ratios of fresh martensite and tempered martensite is set to 20.0% or less. The total of the area ratios of fresh martensite and tempered martensite is preferably 15.0% or less, more preferably 10.0% or less, and still more preferably 5.0% or less.

The lower limit of the total of the area ratios of fresh martensite and tempered martensite is not particularly limited, but may be set to 0.0% or more, 0.5% or more, or 1.0% or more.

Proportion of Area Ratio of Tempered Martensite: 80.0% or More of Total of Area Ratios of Fresh Martensite and Tempered Martensite An increase in the proportion of the area ratio of tempered martensite in the total of the area ratios of fresh martensite and tempered martensite makes it possible to further enhance the hole expansibility of the steel sheet. Therefore, the proportion of the area ratio of tempered martensite in the total of the area ratios of fresh martensite and tempered martensite may be set to 80.0% or more. The proportion of the area ratio of tempered martensite in the total of the area ratios of fresh martensite and tempered martensite is preferably as high as possible and more preferably 90.0% or more and may be set to 100.0%.

The proportion of the area ratio of tempered martensite can be obtained by {area ratio of tempered martensite/(total of area ratios of fresh martensite and tempered martensite)}×100.

Total of Area Ratios of Pearlite, Ferrite, and Austenite: 20.0% or Less

Ferrite and austenite are structures that degrade the strength of the steel sheet. Pearlite is a structure that degrades the hole expansibility of the steel sheet. When the total of the area ratios of these structures is more than 20.0%, desired tensile strength and/or hole expansibility cannot be obtained. Therefore, the total of the area ratios of these structures is set to 20.0% or less. The total of the area ratios of these structures is preferably 17.0% or less and more preferably 15.0% or less.

The lower limit of the total of the area ratios of pearlite, ferrite, and austenite is not particularly limited, but may be set to 0.0% or more, 5.0% or more, or 10.0% or more.

Hereinafter, a method for measuring the area ratio of each structure will be described.

A test piece is collected from the steel sheet such that, in a cross section parallel to a rolling direction, the microstructure at a ¼ depth of the sheet thickness from the surface (a region from a ⅛ depth of the sheet thickness from the surface to a ⅜ depth of the sheet thickness from the surface) and the sheet width direction center position can be observed.

After being polished using silicon carbide paper having a grit of #600 to #1500, a cross section of the test piece is finished into a mirror surface using liquid in which diamond powder having grain sizes of 1 to 6 μm is dispersed in a diluted solution, such as an alcohol, or pure water. Next, the cross section is polished at room temperature using colloidal silica containing no alkaline solution to remove strain introduced into the surface layer of the sample. At an arbitrary position in the longitudinal direction of the sample cross section, a region that is 50 μm in length and is from the ⅛ depth of the sheet thickness from the surface to the ⅜ depth of the sheet thickness from the surface is measured at measurement intervals of 0.1 μm by an electron backscatter diffraction method such that a ¼ depth position of the sheet thickness from the surface can be observed to obtain crystal orientation information.

For the measurement, an EBSD device configured of a thermal field emission scanning electron microscope (JSM-7001F manufactured by JEOL) and an EBSD detector (DVC5 type detector manufactured by TSL) is used. At this time, the degree of vacuum inside the EBSD device is set to $9.6\times10^{-5}$ Pa or less, the acceleration voltage is set to 15 kV, the irradiation current level is set to 13, and the electron beam irradiation level is set to 62. The area ratio of austenite is calculated from the obtained crystal orientation information using a "Phase Map" function installed in software "OIM Analysis (registered trademark)" included in an EBSD analyzer. Therefore, the area ratio of austenite is obtained. Regions having an fcc crystal structure are determined as austenite.

Next, regions having a bcc crystal structure are determined as bainite, ferrite, pearlite, fresh martensite, and tempered martensite. Regarding these regions, regions where "Grain Orientation Spread" is 1° or less under a condition of defining a 15° grain boundary as a grain boundary are extracted as ferrite using a "Grain Orientation Spread" function installed in the software "OIM Analysis (registered trademark)" included in the EBSD analyzer. The area ratio of the extracted ferrite is calculated, thereby obtaining the area ratio of ferrite.

Subsequently, in residual regions (regions where "Grain Orientation Spread" is more than 1°), when the maximum value of "Grain Average IQ" of ferrite regions is represented by Iα under a condition of defining a 5° grain boundary as a grain boundary, regions where "Grain Average IQ" becomes more than Iα/2 are extracted as bainite, and regions where "Grain Average IQ" becomes Iα/2 or less are extracted as "pearlite, fresh martensite, and tempered martensite". The area ratio of the extracted bainite is calculated, thereby obtaining the area ratio of bainite.

Regarding the extracted "pearlite, fresh martensite, and tempered martensite", pearlite, fresh martensite, and tempered martensite are distinguished by the following method.

In order to observe the same region as the EBSD measurement region with a SEM, a Vickers indentation is stamped near an observation position. After that, the structure of an observed section is left, contamination on the surface layer is removed by polishing, and Nital etching is performed. Next, the same visual field as the EBSD observed section is observed with the SEM at a magnification of 3000 times. In the EBSD measurement, among regions determined as "pearlite, fresh martensite, and tempered martensite", regions where a substructure is present within grains and cementite is precipitated in a plurality of variant forms are determined as tempered martensite. Regions where cementite is precipitated in a lamella shape are determined as pearlite. Regions where the brightness is high and a substructure is not exposed by etching are determined as fresh martensite. The area ratio of each is calculated, thereby obtaining the area ratio of tempered martensite, pearlite, or fresh martensite.

Regarding the removal of contaminant on the surface layer of the observed section, a method such as buffing using alumina particles having a particle size of 0.1 μm or less Ar ion sputtering may be used.

Texture at Sheet Thickness ¼ Position: A/B Being 1.50 or Less and A+B Being 6.00 or Less In a crystal orientation distribution function of the texture at a sheet thickness ¼ position, when A/B that is the ratio of the maximum value A of pole densities at $\Phi=20°$ to 60° and $\varphi_1=30°$ to 90° in a cross section of $\varphi_2=450$ to the maximum value B of pole densities at $\Phi=120°$ to 60° and $\varphi_1=30°$ to 90° in the cross section of $\varphi_2=45°$ is more than 1.50 or the total (A+B) of the maximum value A and the maximum value B is more than 6.00, desired hole expansibility cannot be obtained and/or the occurrence of forming damage cannot be suppressed. Therefore, A/B is set to 1.50 or less, and A+B is set to 6.00 or less.

A/B is preferably 1.40 or less, more preferably 1.30 or less, and still more preferably 1.20 or less. The lower limit of A/B is not particularly limited, but may be set to 1.00 or more.

A+B is preferably 5.50 or less, more preferably 5.00 or less, and still more preferably 4.50 or less. The lower limit of A+B is not particularly limited, but may be set to 2.00 or more or 3.00 or more.

The maximum value A and the maximum value B are measured by the following methods.

A sample is collected from the steel sheet so that a cross section parallel to the rolling direction can be observed. The cross section perpendicular to the sheet surface is mechanically polished, and then strain is removed by chemical polishing or electrolytic polishing. For the measurement, a device in which a scanning electron microscope and an EBSD analyzer are combined and OIM Analysis (registered trademark) manufactured by TSL Solutions are used. The sample is analyzed by an EBSD (electron back scattering diffraction) method. A crystal orientation distribution function (ODF) is calculated from the obtained orientation data. The measurement range is set to the sheet thickness ¼ position (a region from a sheet thickness ⅛ depth from the surface to a sheet thickness ⅜ depth from the surface).

The maximum value of the pole densities at $\Phi=20°$ to 60° and $\varphi_1=30°$ to 90° in the cross section $\varphi_2=45°$ is obtained from the obtained crystal orientation distribution function, thereby obtaining the maximum value A. In addition, the maximum value of the pole densities at $\Phi=1200$ to 60° and $\varphi_1=30°$ to 90° in the cross section of $\varphi_2=45°$ is obtained, thereby obtaining the maximum value B.

Tensile Strength: 1030 MPa or More

In the steel sheet according to the present embodiment, the tensile strength is 1030 MPa or more. When the tensile strength is less than 1030 MPa, it is not possible to suitably apply the steel sheet to various automobile suspension components. The tensile strength may be 1050 MPa or more or 1150 MPa or more.

The tensile strength is preferably as high as possible, but may be set to 1450 MPa or less.

The tensile strength is measured by performing a tensile test in accordance with JIS Z 2241: 2011 using a No. 5 test piece of JIS Z 2241: 2011. A position where the tensile test piece is collected is the center position in the sheet width direction, and a direction perpendicular to the rolling direction is the longitudinal direction.

Hole Expansion Rate: 35% or More

In the steel sheet according to the present embodiment, the hole expansion rate may be set to 35% or more. When the hole expansion rate is set to 35% or more, it is possible to suppress the occurrence of forming breakage at the end portion of a cylindrical burring portion. Therefore, it is possible to suitably apply the steel sheet to automobile suspension components. In order to further increase the forming height of the cylindrical burring portion, the hole expansion rate may be set to 40% or more, 45% or more, or 50% or more.

The hole expansion rate is measured by performing a hole expansion test in accordance with JIS Z 2256: 2020.

The steel sheet according to the present embodiment may be made into a surface-treated steel sheet by providing a plating layer on the surface for the purpose of improving corrosion resistance or the like. The plating layer may be an electro plating layer or a hot-dip plating layer. As the electro plating layer, electrogalvanizing, electro Zn—Ni alloy plating, and the like are exemplary examples. As the hot-dip plating layer, hot-dip galvanizing, hot-dip galvannealing, hot-dip aluminizing, hot-dip Zn—Al alloy plating, hot-dip Zn—Al—Mg alloy plating, hot-dip Zn—Al—Mg—Si alloy plating, and the like are exemplary examples. The plating adhesion amount is not particularly limited and may be the same as before. In addition, it is also possible to further enhance the corrosion resistance by performing an appropriate chemical conversion treatment (for example, the application and drying of a silicate-based chromium-free chemical conversion treatment liquid) after plating.

Next, a preferable manufacturing method of the steel sheet according to the present embodiment will be described.

The preferable manufacturing method of a steel sheet according to the present embodiment has

- a step of holding a slab having the above-described chemical composition in a temperature range of 1200° C. or higher for 30 minutes or longer,
- a step of applying a strain of 3% to 15% in a width direction to the slab after the holding, a step of performing finish rolling on the slab to which the strain has been applied so that a final rolling reduction is 24% to 60% and a finishing temperature is in a temperature range of 960° C. to 1060° C., and a step of cooling the steel sheet after the finish rolling so that an average cooling rate in a temperature range of 900° C. to 650° C. becomes 30° C./second or faster and coiling the steel sheet in a temperature range of 400° C. to 580° C.

In addition, the manufacturing method may further include, in addition to the above-described steps, a step of holding the steel sheet after the coiling in a temperature range of 600° C. to 750° C. for 60 to 3010 seconds.

Hereinafter, each step will be described.

The heating temperature of the slab is set to 1200° C. or higher. In addition, the holding time in the temperature range of 1200° C. or higher is set to 30 minutes or longer. When the heating temperature of the slab is lower than 1200° C. or the holding time in the temperature range of 1200° C. or higher is shorter than 30 minutes, it is not possible to sufficiently dissolve a coarse precipitate, and, as a result, a steel sheet having a desired tensile strength cannot be obtained. The upper limit of the heating temperature and the upper limit of the holding time in the temperature range of 1200° C. or higher are not particularly limited, but may be each set to 1300° C. or lower or 300 minutes or shorter.

The slab to be heated is not particularly limited except that the slab has the above-described chemical composition. For example, it is possible to use a slab manufactured by a continuous casting method after molten steel having the above chemical composition is melted using a converter, an electric furnace, or the like. Instead of the continuous casting method, an ingot-making method, a thin slab casting method, or the like may be adopted.

Before finish rolling, a strain of 3% to 15% is applied to the slab in the width direction (rolling orthogonal direction). When the strain that is applied in the width direction is less than 3% or more than 15%, it is not possible to preferably control A/B, which is the ratio of the maximum value A to the maximum value B. As a result, desired hole expansibility cannot be obtained and/or the occurrence of forming damage cannot be suppressed. Therefore, the strain that is applied in the width direction is set to 3% to 15%. The strain that is applied in the width direction is preferably 5% or more and more preferably 7% or more. In addition, the strain that is applied in the width direction is preferably 13% or less and more preferably 11% or less.

The strain that is applied in the width direction of the slab can be represented by $(1-w_1/w_0)\times100(\%)$ when the width-direction length of the slab before the application of the strain is indicated by $w_0$ and the width-direction length of the slab before the application of the strain is indicated by $w_1$. As a method for applying strain in the width direction of the slab, for example, a method in which strain is applied using a roll installed such that the rotation axis becomes perpendicular to the sheet surface of the slab is an exemplary example.

On the heated slab, rough rolling may be performed by a normal method. In the case of performing rough rolling, strain may be applied in the width direction under the above-described conditions before the rough rolling, during the rough rolling, or after the rough rolling.

After strain is applied in the width direction, finish rolling is performed. The finish rolling is performed such that the final rolling reduction becomes 24% to 60% and the finishing temperature is in a temperature range of 960° C. to 1060° C.

When the final rolling reduction of the finish rolling is smaller than 24%, recrystallization is not promoted, and it is not possible to preferably control A+B, which is the total of the maximum value A and the maximum value B. As a result, desired hole expansibility cannot be obtained and/or the occurrence of forming damage cannot be suppressed. The final rolling reduction of the finish rolling is preferably 30% or larger. The upper limit of the final rolling reduction of the finish rolling is set to 60% or smaller from the viewpoint of suppressing an increase in the facility load.

The final rolling reduction of the finish rolling can be represented by $(1-t/t_0)\times100(\%)$ when the sheet thickness after the final pass of the finish rolling is indicated by t and the sheet thickness before the final pass is indicated by $t_0$.

When the finishing temperature (the surface temperature of the steel sheet on the exit side of the final pass of the finish rolling) is lower than 960° C., recrystallization is not promoted, and it is not possible to preferably control A+B, which is the total of the maximum value A and the maximum value B. As a result, desired hole expansibility cannot be obtained and/or the occurrence of forming damage cannot be suppressed. The finishing temperature is preferably 980° C. or higher. The upper limit of the finishing temperature is set to 1060° C. or lower from the viewpoint of suppressing the grain sizes becoming coarse and from the viewpoint of suppressing deterioration of the toughness of the steel sheet.

After the finish rolling, the slab is cooled such that the average cooling rate in a temperature range of 900° C. to 650° C. becomes 30° C./second or faster. When the average cooling rate in the temperature range of 900° C. to 650° C. is slower than 30° C./second, a large amount of ferrite and pearlite are formed, and a desired tensile strength cannot be obtained. The average cooling rate in the temperature range of 900° C. to 650° C. is preferably 50° C./second or faster and more preferably 80° C./second or faster.

The upper limit of the average cooling rate in the temperature range of 900° C. to 650° C. is not particularly limited, but may be set to 300° C./second or slower or 200° C./second or slower.

The average cooling rate mentioned herein is a value obtained by dividing a temperature difference between the start point and end point of a set range by the elapsed time from the start point to the end point. Cooling until coiling after the cooling at the above-described average cooling rate in the temperature range of 900° C. to 650° C. is not particularly limited.

After the above-described cooling, the steel sheet is coiled in a temperature range of 400° C. to 580° C. This makes it possible to obtain the steel sheet according to the present embodiment. When the coiling temperature is lower than 400° C., fresh martensite and tempered martensite are excessively formed, and the hole expansibility of the steel sheet deteriorates. The coiling temperature is preferably 450° C. or higher.

In addition, when the coiling temperature is higher than 580° C., the amount of ferrite increases and a desired tensile strength cannot be obtained. The coiling temperature is preferably 560° C. or lower.

The steel sheet manufactured by the above-described method may be left to be cooled to room temperature or may be cooled with water after coiled into a coil shape.

The coiled steel sheet is uncoiled and pickled, and then soft reduction may be performed thereon. A heat treatment to be described below may be performed without performing pickling and soft reduction. When the cumulative rolling reduction of the soft reduction is too large, the dislocation density increases, and the hole expansibility of the steel sheet deteriorates in some cases. Therefore, in the case of performing soft reduction, the cumulative rolling reduction of the soft reduction is preferably set to 15% or smaller.

The cumulative rolling reduction of the soft reduction can be represented by $(1-t/t_0)\times100(\%)$ when the sheet thickness after the soft reduction is indicated by t and the sheet thickness before the soft reduction is indicated by $t_0$.

After the coiling or the soft reduction, a heat treatment may be performed. In the case of performing the heat treatment, the steel sheet is preferably held in a temperature range of 600° C. to 750° C. for 60 to 3010 seconds. When the heating temperature and holding time during the heat treatment are set within the above-described ranges, an effect of increasing the amount of a fine precipitate and an effect of decreasing the dislocation density can be sufficiently obtained. As a result, it is possible to increase the proportion of tempered martensite in fresh martensite and tempered martensite, and the hole expansibility of the steel sheet can be further enhanced.

The steel sheet according to the present embodiment can be manufactured by a manufacturing method including the above-described steps. In addition, when the above-described preferable steps are further provided, it is possible to increase the proportion of tempered martensite and to further improve the hole expansibility of the steel sheet.

EXAMPLES

Slabs having a chemical composition shown in Table 1 were manufactured by continuous casting. Steel sheets having a sheet thickness of 3.0 mm were manufactured using the obtained slabs under conditions shown in Table 2 and Table 3. Soft reduction and/or a heat treatment were performed under conditions shown in Table 2 and Table 3 as necessary. In examples where the soft reduction was performed, pickling was performed before the soft reduction.

Blank cells in Table 1 indicate that the corresponding element is intentionally not contained. In addition, in Test No. 29 in Table 3, a slab was held at 1189° C. for 46 minutes. In addition, in Test No. 10 in Table 3, the heat treatment was not performed.

For the obtained steel sheets, the area fractions of each structure, the maximum values A, the maximum values B, the tensile strengths, and the hole expansion rates were obtained by the above-described methods. The obtained results are shown in Table 4 and Table 5.

In Table 4 and Table 5, "A/B" indicates the ratio of the maximum value A of pole densities at $\Phi=20°$ to 60° and $\varphi_1=30°$ to 90° in a cross section of $\varphi_2=45°$ to the maximum value B of pole densities at $\Phi=120°$ to 60° and $\varphi_1=30°$ to 90° in the cross section of $\varphi_2=45°$ in the crystal orientation distribution function of the texture at a sheet thickness ¼ position, and "A+B" indicates the total of the maximum value A and the maximum value B.

"B" indicates bainite, "α+P+γ" indicates ferrite, pearlite, and austenite, and "FM+TM" indicates fresh martensite and tempered martensite. "Proportion of TM" indicates the proportion of the area ratio of tempered martensite in the total of the area ratios of fresh martensite and tempered martensite.

Hat components shown in FIG. 1 were manufactured from the obtained steel sheets.

A load of 10 mm/sec was applied to the center position of a surface S of the hat component in FIG. 1. In a case where there was no decrease in the load attributed to breakage at portions A, A', B, and B' until maximum load was reached, steel sheets were considered to have a sufficient component strength and be capable of suppressing the occurrence of forming damage and determined as acceptable, and "OK" was entered in the columns of "load decrease" in the tables. On the other hand, in a case where a decrease in the load was caused due to breakage at portions A, A', B, and B' until maximum load was reached, steel sheets were considered to not have a sufficient component strength and be not capable of suppressing the occurrence of forming damage and determined as unacceptable, and "NG" was entered in the columns of "load decrease" in the tables.

In a case where the tensile strength was 1030 MPa or more, steel sheets were determined as acceptable for having a high strength, and, in a case where the tensile strength was less than 1030 MPa, steel sheets were determined as unacceptable for not having a high strength.

In addition, in a case where the hole expansion rate was 35% or more, steel sheets were determined as acceptable for being excellent in terms of hole expansibility, and, in a case where the hole expansion rate was less than 35%, steel sheets were determined as unacceptable for being poor in terms of hole expansibility. Particularly, in examples where the hole expansion rate was 45% or more, the steel sheets were determined as being superior in terms of hole expansibility.

TABLE 1

| | Chemical composition (mass %), remainder being Fe and impurity | | | | | | | | | | | | | | |
|---|---|---|---|---|---|---|---|---|---|---|---|---|---|---|---|
| Steel | C | Si | Mn | Al | P | S | N | Ti | Nb | Mo | V | B | Cr | Ti + Nb + V + Mo | Note |
| A | 0.020 | 0.272 | 1.72 | 0.310 | 0.0090 | 0.0030 | 0.0028 | 0.130 | 0:015 | 0.003 | 0.100 | | 0.003 | 0.248 | Comparative Steel |
| B | 0.105 | 0.560 | 2.50 | 0.050 | 0.0080 | 0.0040 | 0.0032 | 0.130 | 0.018 | 0.100 | 0.200 | 0.0002 | | 0.448 | Present Invention Steel |
| C | 0.190 | 0.941 | 2.70 | 0.030 | 0.0100 | 0.0020 | 0.0033 | 0.130 | 0.012 | 0.003 | 0.100 | 0.0003 | 0.004 | 0.245 | Comparative Steel |
| D | 0.085 | 0.054 | 2.41 | 0.512 | 0.0090 | 0.0030 | 0.0030 | 0.130 | 0.011 | 0.002 | 0.155 | | 0.003 | 0.298 | Present Invention Steel |
| E | 0.079 | 0.436 | 2.80 | 0.030 | 0.0070 | 0.0020 | 0.0038 | 0.130 | 0.010 | 0.002 | 0.200 | | 0.002 | 0.342 | Present Invention Steel |
| F | 0.090 | 1.003 | 2.98 | 0.270 | 0.0080 | 0.0035 | 0.0035 | 0.130 | 0.022 | 0.002 | 0.100 | 0.0003 | 0.003 | 0.254 | Present Invention Steel |
| G | 0.132 | 1.510 | 2.90 | 0.020 | 0.0090 | 0.0032 | 0.0028 | 0.130 | 0.015 | 0.002 | 0.200 | 0.0002 | 0.004 | 0.347 | Comparative Steel |

TABLE 1-continued

| Steel | Chemical composition (mass %), remainder being Fe and impurity | | | | | | | | | | | | | | |
|---|---|---|---|---|---|---|---|---|---|---|---|---|---|---|---|
| | C | Si | Mn | Al | P | S | N | Ti | Nb | Mo | V | B | Cr | Ti + Nb + V + Mo | Note |
| H | 0.127 | 0.863 | 1.51 | 0.030 | 0.0060 | 0.0021 | 0.0022 | 0.130 | 0:016 | | 0.100 | 0.0003 | | 0.246 | Comparative Steel |
| I | 0.175 | 0.786 | 2.60 | 0.022 | 0.0070 | 0.0018 | 0.0031 | 0.130 | 0.012 | 0.003 | 0.200 | | 0.003 | 0.345 | Present Invention Steel |
| J | 0.087 | 0.482 | 3.10 | 0.018 | 0.0060 | 0.0036 | 0.0028 | 0.130 | 0.011 | | 0.100 | 0.0002 | | 0.241 | Comparative Steel |
| K | 0.178 | 1.307 | 2.80 | 0.020 | 0.0100 | 0.0030 | 0.0025 | 0.130 | 0.011 | 0.003 | 0.100 | | 0.004 | 0.244 | Present Invention Steel |
| L | 0.067 | 0.039 | 2.63 | 0.030 | 0.0080 | 0.0026 | 0.0031 | 0.130 | 0.037 | | 0.100 | | 0.003 | 0.267 | Present Invention Steel |
| M | 0.087 | 0.054 | 2.48 | 0.715 | 0.0090 | 0.0026 | 0.0029 | 0.130 | 0.011 | 0.003 | 0.100 | | 0.003 | 0.244 | Comparative Steel |
| N | 0.066 | 0.047 | 1.75 | 0.020 | 0.0090 | 0.0026 | 0.0029 | 0.130 | 0.021 | | 0.100 | 0.0002 | | 0.251 | Present Invention Steel |
| O | 0.071 | 0.037 | 2.59 | 0.029 | 0.0080 | 0.0026 | 0.0030 | 0.130 | 0.003 | | 0.100 | 0.0002 | 0.004 | 0.233 | Comparative Steel |
| P | 0.116 | 0.723 | 2.40 | 0.021 | 0.0070 | 0.0019 | 0.0031 | 0.130 | 0.036 | | 0.100 | | 0.003 | 0.266 | Present Invention Steel |
| Q | 0.129 | 0.560 | 2.07 | 0.032 | 0.0068 | 0.0022 | 0.0027 | 0.130 | 0.072 | 0.002 | 0.100 | | 0.004 | 0.304 | Comparative Steel |
| R | 0.160 | 1.104 | 2.08 | 0.032 | 0.0080 | 0.0030 | 0.0070 | 0.130 | 0.026 | 0.002 | 0.100 | 0.0002 | 0.002 | 0.258 | Comparative Steel |
| S | 0.138 | 0.552 | 2.91 | 0.032 | 0.0080 | 0.0020 | 0.0028 | 0.010 | 0.020 | 0.002 | 0.100 | 0.0014 | 0.003 | 0.132 | Comparative Steel |
| T | 0.140 | 0.568 | 2.96 | 0.100 | 0.0060 | 0.0030 | 0.0034 | 0.020 | 0.021 | 0.230 | | | 0.030 | 0.271 | Present: Invention Steel |
| U | 0.152 | 0.918 | 2.43 | 0.030 | 0.0080 | 0.0022 | 0.0032 | 0.020 | 0.011 | 0.020 | 0.040 | 0.0003 | | 0.091 | Comparative Steel |
| V | 0.122 | 0.747 | 2.41 | 0.040 | 0.0080 | 0.0040 | 0.0025 | 0.200 | 0.032 | 0.068 | 0.200 | 0.0017 | 0.030 | 0.500 | Comparative Steel |
| W | 0.098 | 0.342 | 1.97 | 0.173 | 0.0082 | 0.0042 | 0.0032 | 0.130 | 0.018 | 0.620 | 0.063 | 0.0014 | 0.082 | 0.831 | Comparative Steel |
| X | 0.064 | 0.032 | 1.75 | 0.020 | 0.0060 | 0.0020 | 0.0031 | 0.130 | 0.030 | 0.081 | 0.310 | | 0.373 | 0.551 | Comparative Steel |
| Y | 0.090 | 1.200 | 2.63 | 0.020 | 0.0070 | 0.0010 | 0.0031 | 0.150 | 0.020 | | | | | 0.170 | Present Invention Steel |
| Z | 0.101 | 0.540 | 2.45 | 0.040 | 0.0700 | 0.0035 | 0.0034 | 0.165 | 0.030 | 0.590 | 0.290 | 0.0002 | | 1.075 | Present Invention Steel |
| AA | 0.111 | 0.520 | 2.65 | 0.020 | 0.0065 | 0.0030 | 0.0028 | 0.180 | 0.022 | 0.600 | 0.400 | 0.0020 | | 1.202 | Comparative Steel |

Underlines indicate that the corresponding values are outside the scope of the present invention.

TABLE 2

| Test No. | Steel | Slab heating temperature ° C. | Holding time of slab heating min | Strain in width direction % | Final rolling reduction of finish rolling % | Finishing temperature ° C. | Cooling rate in temperature range of 900° C. to 650° C. ° C./sec | Coiling temperature ° C. | Cumulative rolling reduction of soft reduction % | Heating temperature during heat treatment ° C. | Holding time during heat treatment sec | Note |
|---|---|---|---|---|---|---|---|---|---|---|---|---|
| 1 | A | 1225 | 121 | 7 | 42 | 971 | 132 | 432 | 5 | 711 | 501 | Comparative Example |
| 2 | B | 1220 | 131 | 1 | 25 | 1022 | 186 | 504 | 5 | 710 | 795 | Comparative Example |
| 3 | B | 1234 | 74 | 4 | 46 | 1038 | 71 | 567 | 10 | 713 | 2000 | Present Invention Example |
| 4 | B | 1243 | 42 | 12 | 31 | 998 | 168 | 486 | 5 | 665 | 1265 | Present Invention Example |
| 5 | B | 1229 | 167 | 18 | 44 | 992 | 141 | 402 | 10 | 696 | 2912 | Comparative Example |
| 6 | C | 1236 | 175 | 12 | 37 | 1055 | 198 | 477 | 5 | 681 | 2853 | Comparative Example |
| 7 | D | 1236 | 148 | 13 | 33 | 1059 | 66 | 560 | 0 | 642 | 1765 | Present Invention Example |
| 8 | E | 1240 | 238 | 2 | 49 | 972 | 107 | 431 | 0 | 738 | 2588 | Comparative Example |

TABLE 2-continued

| Test No. | Steel | Slab heating temperature ° C. | Holding time of slab heating min | Strain in width direction % | Final rolling reduction of finish rolling % | Finishing temperature ° C. | Cooling rate in temperature range of 900° C. to 650° C. ° C./sec | Coiling temperature ° C. | Cumulative rolling reduction of soft reduction % | Heating temperature during heat treatment ° C. | Holding time during heat treatment sec | Note |
|---|---|---|---|---|---|---|---|---|---|---|---|---|
| 9 | E | 1238 | 233 | 14 | 12 | 994 | 158 | 485 | 0 | 623 | 1354 | Comparative Example |
| 10 | E | 1233 | 154 | 8 | 50 | 1000 | 161 | 490 | 15 | 0 | 0 | Present Invention Example |
| 11 | E | 1217 | 88 | 5 | 25 | 1032 | 193 | 501 | 0 | 741 | 795 | Present Invention Example |
| 12 | E | 1235 | 67 | 17 | 31 | 1045 | 178 | 508 | 0 | 738 | 648 | Comparative Example |
| 13 | E | 1222 | 77 | 10 | 54 | 950 | 95 | 551 | 5 | 699 | 971 | Comparative Example |
| 14 | F | 1220 | 45 | 6 | 41 | 978 | 37 | 456 | 10 | 720 | 501 | Present Invention Example |
| 15 | F | 1220 | 84 | 7 | 48 | 982 | 28 | 414 | 5 | 632 | 1824 | Comparative Example |
| 16 | F | 1225 | 69 | 11 | 44 | 1018 | 195 | 526 | 5 | 606 | 1118 | Present Invention Example |
| 17 | F | 1219 | 76 | 17 | 38 | 972 | 132 | 501 | 5 | 705 | 2912 | Comparative Example |
| 18 | G | 1229 | 73 | 14 | 37 | 1056 | 37 | 521 | 10 | 738 | 1060 | Comparative Example |
| 19 | H | 1227 | 173 | 9 | 43 | 974 | 125 | 452 | 10 | 707 | 119 | Comparative Example |
| 20 | I | 1230 | 108 | 13 | 48 | 990 | 96 | 405 | 5 | 760 | 2089 | Comparative Example |
| 21 | I | 1238 | 111 | 7 | 56 | 1012 | 178 | 508 | 5 | 738 | 913 | Present Invention Example |
| 22 | I | 1232 | 106 | 7 | 21 | 1045 | 54 | 539 | 10 | 603 | 1207 | Comparative Example |
| 23 | I | 1222 | 82 | 17 | 40 | 1034 | 178 | 490 | 10 | 696 | 148 | Comparative Example |
| 24 | I | Slab cracking occurs | | | | | | | | | | Comparative Example |
| 25 | L | 1227 | 100 | 3 | 56 | 1020 | 37 | 522 | 10 | 710 | 1236 | Present Invention Example |

Underlines indicate that the corresponding values are outside the scope of the present invention.

TABLE 3

| Test No. | Steel | Slab heating temperature ° C. | Holding time of slab heating min | Strain in width direction % | Final rolling reduction of finish rolling % | Finishing temperature ° C. | Cooling rate in temperature range of 900° C. to 650° C. ° C./sec | Coiling temperature ° C. | Cumulative rolling reduction of soft reduction % | Heating temperature during heat treatment ° C. | Holding time during heat treatment sec | Note |
|---|---|---|---|---|---|---|---|---|---|---|---|---|
| 26 | L | 1229 | 100 | 8 | 51 | 1007 | 198 | 553 | 5 | 666 | 2049 | Present Invention Example |
| 27 | L | 1232 | 126 | 14 | 20 | 1034 | 98 | 420 | 0 | 645 | 2471 | Comparative Example |
| 28 | M | Nozzle clogging occurs | | | | | | | | | | Comparative Example |
| 29 | N | 1189 | 46 | 9 | 37 | 966 | 98 | 575 | 0 | 641 | 1971 | Comparative Example |
| 30 | N | 1240 | 29 | 14 | 41 | 1046 | 158 | 434 | 0 | 600 | 1207 | Comparative Example |
| 31 | N | 1230 | 39 | 6 | 42 | 982 | 125 | 600 | 0 | 690 | 2735 | Comparative Example |

TABLE 3-continued

| Test No. | Steel | Slab heating temperature ° C. | Holding time of slab heating min | Strain in width direction % | Final rolling reduction of finish rolling % | Finishing temperature ° C. | Cooling rate in temperature range of 900° C. to 650° C. ° C./sec | Coiling temperature ° C. | Cumulative rolling reduction of soft reduction % | Heating temperature during heat treatment ° C. | Holding time during heat treatment sec | Note |
|---|---|---|---|---|---|---|---|---|---|---|---|---|
| 32 | N | 1223 | 38 | 11 | 37 | 1051 | 81 | 567 | 0 | 678 | 1618 | Present Invention Example |
| 33 | O | 1230 | 154 | 4 | 39 | 965 | 124 | 450 | 0 | 702 | 60 | Comparative Example |
| 34 | P | 1241 | 139 | 9 | 42 | 1040 | 56 | 569 | 0 | 678 | 2324 | Present Invention Example |
| 35 | O | | | | | Slab cracking occurs | | | | | | Comparative Example |
| 36 | R | 1320 | 153 | 12 | 56 | 1017 | 193 | 513 | 0 | 741 | 103 | Comparative Example |
| 37 | S | 1272 | 143 | 5 | 33 | 962 | 103 | 567 | 0 | 600 | 1706 | Comparative Example |
| 38 | T | 1269 | 232 | 9 | 41 | 1050 | 86 | 575 | 0 | 642 | 1912 | Present Invention Example |
| 39 | T | 1238 | 259 | 14 | 31 | 1040 | 10 | 468 | 0 | 651 | 14760 | Comparative Example |
| 40 | T | 1224 | 273 | 17 | 41 | 979 | 120 | 438 | 0 | 680 | 2647 | Comparative Example |
| 41 | U | 1223 | 218 | 11 | 46 | 989 | 139 | 423 | 0 | 674 | 2530 | Comparative Example |
| 42 | V | 1223 | 221 | 5 | 25 | 1021 | 79 | 423 | 0 | 665 | 2147 | Comparative Example |
| 43 | W | 1242 | 228 | 10 | 50 | 1005 | 181 | 515 | 0 | 343 | 1148 | Comparative Example |
| 44 | X | 1256 | 269 | 3 | 45 | 1034 | 42 | 429 | 0 | 611 | 2530 | Comparative Example |
| 45 | Y | 1242 | 121 | 5 | 45 | 980 | 31 | 405 | 0 | 602 | 61 | Present Invention Example |
| 46 | Y | 1250 | 115 | 10 | 40 | 990 | 51 | 300 | 0 | 610 | 120 | Comparative Example |
| 47 | Z | 1240 | 120 | 9 | 43 | 1035 | 47 | 533 | 10 | 638 | 1941 | Present Invention Example |
| 48 | AA | 1245 | 105 | 11 | 41 | 1015 | 45 | 531 | 10 | 622 | 1050 | Comparative Example |
| 49 | Y | 1250 | 115 | 10 | 40 | 990 | 51 | 382 | 0 | 610 | 120 | Comparative Example |
| 50 | I | 1233 | 154 | 7 | 40 | 962 | 107 | 540 | 10 | 601 | 210 | Present Invention Example |

Underlines indicate that the corresponding values are outside the scope of the present invention.

TABLE 4

| Test No. | Steel | A/B | A + B | B area % | α + P + γ area % | FM + TM area % | Proportion of TM % | Tensile strength MPa | Hole expansion rate % | Load decrease | Note |
|---|---|---|---|---|---|---|---|---|---|---|---|
| 1 | A | 1.15 | 4.35 | 72.3 | 27.4 | 0.3 | 86.9 | 975 | 61 | NG | Comparative Example |
| 2 | B | 1.70 | 4.62 | 82.3 | 16.6 | 1.1 | 90.9 | 1260 | 45 | NG | Comparative Example |
| 3 | B | 1.30 | 4.89 | 86.1 | 13.0 | 0.9 | 85.8 | 1282 | 46 | OK | Present Invention Example |
| 4 | B | 1.28 | 3.57 | 87.5 | 11.3 | 1.2 | 77.0 | 1256 | 36 | OK | Present Invention Example |
| 5 | B | 1.67 | 4.47 | 88.3 | 10.4 | 1.3 | 78.4 | 1308 | 37 | NG | Comparative Example |
| 6 | C | 1.30 | 5.37 | 69.5 | 0.5 | 30.0 | 75.9 | 1266 | 26 | OK | Comparative Example |
| 7 | D | 1.34 | 5.28 | 80.2 | 17.2 | 2.6 | 89.3 | 1184 | 47 | OK | Present Invention Example |
| 8 | E | 1.53 | 4.17 | 84.3 | 15.4 | 0.3 | 90.3 | 1094 | 58 | NG | Comparative Example |
| 9 | E | 1.38 | 7.00 | 83.0 | 16.8 | 0.2 | 79.0 | 1053 | 22 | NG | Comparative Example |
| 10 | B | 1.15 | 4.17 | 83.1 | 16.6 | 0.3 | 20.0 | 1072 | 35 | OK | Present Invention Example |
| 11 | E | 1.28 | 5.88 | 84.3 | 15.4 | 0.3 | 80.2 | 1120 | 45 | OK | Present Invention Example |
| 12 | E | 1.62 | 5.28 | 84.3 | 15.4 | 0:3 | 83.1 | 1094 | 54 | NG | Comparative Example |

TABLE 4-continued

| Test No. | Steel | A/B | A + B | B area % | α + P + γ area % | FM + TM area % | Proportion of TM % | Tensile strength MPa | Hole expansion rate % | Load decrease | Note |
|---|---|---|---|---|---|---|---|---|---|---|---|
| 13 | B | 1.19 | 9.20 | 80.5 | 19.1 | 0.4 | 78.5 | 1040 | 20 | NG | Comparative Example |
| 14 | F | 1.24 | 3.60 | 81.5 | 13.7 | 4.8 | 83.6 | 1045 | 47 | OK | Present Invention Example |
| 15 | F | 1.17 | 4.11 | 68.4 | 26.0 | 5.6 | 89.1 | 954 | 41 | OK | Comparative Example |
| 16 | F | 1.26 | 5:04 | 81.3 | 15.5 | 3.2 | 92.8 | 1082 | 46 | OK | Present Invention Example |
| 17 | F | 1.63 | 5.16 | 80.6 | 13.1 | 6.3 | 88.5 | 1075 | 41 | NG | Comparative Example |
| 18 | G | 1.43 | 3.18 | 65.0 | 25.0 | 10.0 | 78.7 | 1312 | 21 | OK | Comparative Example |
| 19 | H | 1.20 | 3.51 | 70.6 | 27.3 | 2.1 | 85.5 | 963 | 42 | OK | Comparative Example |
| 20 | I | 1.35 | 5.85 | 72.0 | 3.0 | 25.0 | 74.7 | 1354 | 15 | OK | Comparative Example |
| 21 | I | 1.17 | 4.44 | 81.8 | 14.0 | 4.2 | 76.5 | 1254 | 35 | OK | Present Invention Example |
| 22 | I | 1.19 | 8.50 | 88.1 | 4.3 | 7.6 | 78.6 | 1331 | 20 | NG | Comparative Example |
| 23 | I | 1.59 | 4.86 | 87.1 | 5.6 | 7.3 | 80.7 | 1270 | 34 | NG | Comparative Example |
| 24 | I | | | | | Slab cracking occurs | | | | | Comparative Example |
| 25 | L | 1.40 | 3.84 | 81.2 | 16.2 | 2.6 | 93.2 | 1032 | 48 | OK | Present Invention Example |

Underlines indicate that the corresponding values are outside the scope of the present invention.

TABLE 5

| Test No. | Steel | A/B | A + B | B area % | α + P + γ area % | FM + TM area % | Proportion of TM % | Tensile strength MPa | Hole expansion rate % | Load decrease | Note |
|---|---|---|---|---|---|---|---|---|---|---|---|
| 26 | L | 1.15 | 4.38 | 80.7 | 17.0 | 2.3 | 95.2 | 1037 | 54 | OK | Present Invention Example |
| 27 | L | 1.39 | 8.00 | 81.0 | 17.7 | 1.3 | 78.0 | 1040 | 25 | NG | Comparative Example |
| 28 | M | | | | | Nozzle clogging occurs | | | | | Comparative Example |
| 29 | N | 1.19 | 5.97 | 83.1 | 15.1 | 1.8 | 83.9 | 975 | 35 | OK | Comparative Example |
| 30 | N | 1.37 | 5.19 | 87.7 | 10.2 | 2.1 | 82.0 | 921 | 36 | OK | Comparative Example |
| 31 | N | 1.22 | 3.66 | 53.7 | 45.0 | 1.3 | 82.3 | 967 | 42 | OK | Comparative Example |
| 32 | N | 1.27 | 3.72 | 80.6 | 18.3 | 1.1 | 80.0 | 1036 | 51 | OK | Present Invention Example |
| 33 | O | 1.31 | 3.36 | 80.6 | 17.8 | 1.6 | 83.0 | 951 | 61 | OK | Comparative Example |
| 34 | P | 1.18 | 5.31 | 86.3 | 11.5 | 2.2 | 88.5 | 1283 | 45 | OK | Present Invention Example |
| 35 | O | | | | | Slab cracking occurs | | | | | Comparative Example |
| 36 | R | 1.26 | 4.53 | 78.0 | 1.0 | 21.0 | 79.0 | 1270 | 21 | OK | Comparative Example |
| 37 | S | 1.28 | 5.55 | 82.3 | 14.6 | 3.1 | 81.7 | 960 | 45 | OK | Comparative Example |
| 38 | T | 1.18 | 5.40 | 83.2 | 12.6 | 4.2 | 88.7 | 1200 | 46 | OK | Present Invention Example |
| 39 | T | 1.38 | 3.18 | 73.4 | 20.0 | 6.6 | 75.7 | 990 | 22 | OK | Comparative Example |
| 40 | T | 1.59 | 4.62 | 82.2 | 13.7 | 4.1 | 86.0 | 1100 | 40 | NG | Comparative Example |
| 41 | U | 1.28 | 3.96 | 88.9 | 8.0 | 3.1 | 79.2 | 970 | 36 | OK | Comparative Example |
| 42 | V | 1.28 | 4.59 | 84.0 | 12.4 | 3.6 | 76.9 | 1253 | 15 | OK | Comparative Example |
| 43 | W | 1.17 | 4.02 | 82.9 | 14.8 | 2.3 | 78.7 | 1240 | 22 | OK | Comparative Example |
| 44 | X | 1.45 | 4.68 | 80.3 | 18.7 | 1.0 | 76.4 | 1190 | 21 | OK | Comparative Example |
| 45 | Y | 1.40 | 3.00 | 81.5 | 14.0 | 4.5 | 85.0 | 1031 | 46 | OK | Present Invention Example |
| 46 | Y | 1.20 | 4.00 | 46.0 | 14.0 | 40.0 | 81.0 | 1140 | 19 | OK | Comparative Example |
| 47 | Z | 1.17 | 3.15 | 88.2 | 11.0 | 0.9 | 82.0 | 1277 | 35 | OK | Present Invention Example |
| 48 | AA | 1.21 | 3.44 | 81.3 | 12.0 | 1.0 | 79.0 | 1295 | 11 | OK | Comparative Example |
| 49 | Y | 1.20 | 4.00 | 60.0 | 10.0 | 23.0 | 81.0 | 1182 | 31 | OK | Comparative Example |
| 50 | I | 1.20 | 5.85 | 87.3 | 12.5 | 19.0 | 81.0 | 1100 | 35 | OK | Present Invention Example |

Underlines indicate that the corresponding values are outside the scope of the present invention.

From Table 4 and Table 5, it is found that steel sheets according to present invention examples had a high strength and excellent hole expansibility and were capable of suppressing the occurrence of forming damage. It is found that, among the present invention examples, steel sheets where the proportion of the area ratio of tempered martensite in the total of the area ratios of fresh martensite and tempered martensite was 80.0% or more were superior in terms of hole expansibility.

On the other hand, it is found that steel sheets according to comparative example were poor in terms of any one or more of the properties.

INDUSTRIAL APPLICABILITY

According to the above-described aspects of the present invention, it is possible to provide a steel sheet having a high strength and excellent hole expansibility and being capable of suppressing the occurrence of forming damage and a manufacturing method thereof. In addition, according to preferable aspects of the present invention, it is possible to provide a steel sheet having superior hole expansibility and a manufacturing method thereof.

What is claimed is:

1. A steel sheet comprising, as a chemical composition, by mass %:

C: 0.030% to 0.180%;
Si: 0.030% to 1.400%;
Mn: 1.60% to 3.00%;
Al: 0.010% to 0.700%;
P: 0.0800% or less;
S: 0.0100% or less;
N: 0.0050% or less;
Ti: 0.020% to 0.180%;
Nb: 0.010% to 0.050%;

Mo: 0% to 0.600%;
V: 0% to 0.300%;
a total of Ti, Nb, Mo, and V: 0.100% to 1.130%;
B: 0% to 0.0030%;
Cr: 0% to 0.500%; and
a remainder of Fe and impurities,
in which a microstructure includes, in terms of area ratio,
bainite: 80.0% or more,
a total of fresh martensite and tempered martensite: 20.0% or less, and
a total of pearlite, ferrite, and austenite: 20.0% or less,
in a crystal orientation distribution function of a texture at a sheet thickness ¼ position,
A/B that is a ratio of a maximum value A of pole densities at $\Phi$=20° to 60° and $\varphi_1$=30° to 90° in a cross section of $\varphi_2$=45° to a maximum value B of pole densities at $\Phi$=120° to 60° and $\varphi_1$=30° to 90° in the cross section of $\varphi_2$=45° is 1.50 or less,
a total of the maximum value A and the maximum value B is 6.00 or less, and
a tensile strength is 1030 MPa or more.

2. The steel sheet according to claim 1,
wherein a proportion of the area ratio of the tempered martensite in the total of the area ratios of the fresh martensite and the tempered martensite is 80.0% or more.

3. The steel sheet according to claim 1, comprising, as the chemical composition, by mass %, one or more of, as the chemical composition:
Mo: 0.001% to 0.600%,
V: 0.010% to 0.300%,
B: 0.0001% to 0.0030%, and
Cr: 0.001% to 0.500%.

4. A manufacturing method of the steel sheet according to claim 1, comprising:
a step of holding a slab having the chemical composition according to claim 1 in a temperature range of 1200° C. or higher for 30 minutes or longer;
a step of applying a strain of 3% to 15% in a width direction to the slab after the holding;
a step of performing finish rolling on the slab to which the strain has been applied so that a final rolling reduction is 24% to 60% and a finishing temperature is in a temperature range of 960° C. to 1060° C.; and
a step of cooling the steel sheet after the finish rolling so that an average cooling rate in a temperature range of 900° C. to 650° C. becomes 30° C./second or faster and coiling the steel sheet in a temperature range of 400° C. to 580° C.

5. The manufacturing method of the steel sheet according to claim 4, further comprising:
a step of holding the steel sheet after the coiling in a temperature range of 600° C. to 750° C. for 60 to 3010 seconds.

6. The steel sheet according to claim 2, comprising, as the chemical composition, by mass %, one or more of, as the chemical composition:
Mo: 0.001% to 0.600%,
V: 0.010% to 0.300%,
B: 0.0001% to 0.0030%, and
Cr: 0.001% to 0.500%.

* * * * *